US010823451B2

(12) United States Patent
Gohring et al.

(10) Patent No.: US 10,823,451 B2
(45) Date of Patent: Nov. 3, 2020

(54) LOUVER ASSEMBLY

(71) Applicants: Eric Gohring, Erlanger, KY (US); Michael Binkholder, Union, KY (US)

(72) Inventors: Eric Gohring, Erlanger, KY (US); Michael Binkholder, Union, KY (US)

(73) Assignee: MESTEK, INC., Westfield, MA (US)

( * ) Notice: Subject to any disclaimer, the term of this patent is extended or adjusted under 35 U.S.C. 154(b) by 160 days.

(21) Appl. No.: 16/057,975

(22) Filed: Aug. 8, 2018

(65) Prior Publication Data

US 2018/0347849 A1 Dec. 6, 2018

Related U.S. Application Data

(62) Division of application No. 12/580,367, filed on Oct. 16, 2009, now Pat. No. 10,760,817.

(60) Provisional application No. 61/196,533, filed on Oct. 17, 2008.

(51) Int. Cl.
*F24F 13/18* (2006.01)
*F24F 13/08* (2006.01)

(52) U.S. Cl.
CPC ..... *F24F 13/18* (2013.01); *F24F 13/08* (2013.01)

(58) Field of Classification Search
CPC ..... F24F 13/08; F24F 13/18; F24F 2007/003; F24F 2221/52; E06B 1/70; E06B 7/02; E06B 7/14; E06B 7/26
USPC ..... 454/277
See application file for complete search history.

(56) References Cited

U.S. PATENT DOCUMENTS 1,995,456 A * 3/1935 Kannel ..... F24F 13/08 454/224
2,158,298 A * 5/1939 Oftedal ..... E06B 3/44 49/476.1
2,480,562 A * 8/1949 Ewing ..... B63J 2/10 454/283
3,056,343 A * 10/1962 Westerberg ..... E06B 7/082 454/279
D194,410 S * 1/1963 Bishop ..... D23/388
3,358,580 A * 12/1967 Freese ..... F24F 13/08 454/277
3,762,301 A * 10/1973 Gilbert ..... F24F 13/072 454/306

(Continued)

FOREIGN PATENT DOCUMENTS

CH 671995 A5 * 10/1989 ..... E06B 1/342

*Primary Examiner* — Edelmira Bosques
*Assistant Examiner* — Phillip Decker
(74) *Attorney, Agent, or Firm* — Grogan, Tuccillo & Vanderleeden, LLP

(57) ABSTRACT

A louver assembly for placement in an opening for regulating the inlet of air, comprising a first blade stack and second blade stack arranged in tandem, and a sill for supporting the first and second blade stack. The first and second blade stacks have a plurality of blades arranged in a horizontally-spaced and vertically-extending configuration defining a plurality of horizontally-spaced and vertical extending air passageways for the passage of air therethrough. The sill has a generally planar first portion for supporting the first blade stack and a sloped second portion for supporting the second blade stack, wherein the sloped portion and the second blade stack define therebetween a void for equalizing pressure within the assembly to facilitate the draining of water therefrom.

15 Claims, 6 Drawing Sheets

(56) References Cited

U.S. PATENT DOCUMENTS 3,771,430 A * 11/1973 Lane ..... E06B 7/08 454/277
3,782,050 A * 1/1974 Dowdell ..... F24F 13/08 52/473
3,851,420 A * 12/1974 Tibbetts ..... E06B 1/70 49/471
3,953,183 A * 4/1976 Regehr ..... B01D 45/08 55/440
4,064,670 A * 12/1977 Lichtenwald ..... E06B 7/082 52/473
4,691,487 A * 9/1987 Kessler ..... E06B 7/14 137/527.8
4,958,555 A * 9/1990 Lentz ..... F24F 13/08 454/277
5,048,253 A * 9/1991 Olsen ..... E06B 7/082 454/313
5,090,774 A * 2/1992 Dolla ..... B60R 19/00 296/187.08
5,201,879 A * 4/1993 Steele ..... F24F 13/08 174/16.1
5,254,034 A * 10/1993 Roth ..... F24F 13/08 454/277
5,268,011 A * 12/1993 Wurz ..... B01D 45/08 55/294
5,297,373 A * 3/1994 Olsen ..... E06B 7/082 52/473
5,542,224 A * 8/1996 Olsen ..... F24F 13/08 52/473
5,601,130 A * 2/1997 Werner ..... E06B 9/0638 160/118
5,755,069 A * 5/1998 Sullivan ..... E06B 7/082 454/277
5,839,244 A * 11/1998 Johnson ..... F24F 13/08 52/473
5,906,083 A * 5/1999 Olsen ..... E06B 7/08 454/277
6,041,560 A * 3/2000 Larson ..... E06B 1/702 49/468
6,076,314 A * 6/2000 Simonton ..... E06B 3/44 49/504
6,095,225 A * 8/2000 Miller ..... E06B 9/15 160/133
6,138,424 A * 10/2000 Akerson ..... F24F 13/082 454/279
6,149,515 A * 11/2000 Van Becelaere ..... F24F 13/075 454/277
6,475,079 B1 * 11/2002 Basey ..... F24F 13/075 454/309
7,784,522 B2 * 8/2010 Miller ..... E06B 9/15 160/133
8,117,789 B2 * 2/2012 Teodorovich ..... E06B 1/702 49/471
D750,276 S * 2/2016 Hicks ..... D25/48.4
10,760,817 B2 * 9/2020 Gohring ..... F24F 13/18
2006/0107604 A1 * 5/2006 Burton ..... E06B 1/702 52/11
2018/0149384 A1 * 5/2018 Rockhold ..... F24F 13/082

* cited by examiner

LOUVER ASSEMBLY

CROSS REFERENCE TO RELATED APPLICATIONS

This application is a divisional application of U.S. patent application Ser. No. 12/580,367 filed on Oct. 16, 2009, which claims the benefit of U.S. Provisional Application Ser. No. 61/196,533, filed on Oct. 17, 2008, herein incorporated by reference in its entireties.

FIELD OF THE INVENTION

The present invention relates generally to a louver assembly that helps regulate the inlet of outside ambient air. More particularly, the invention relates to a storm louver assembly which substantially prevents air-born particulates (such as rain droplets) that are entrained in the ambient air, from passing therethrough and into the building or enclosure with which the louver assembly is associated.

BACKGROUND OF THE INVENTION

Ventilation/HVAC systems for buildings and other enclosures are well known in the art. A core component of many ventilation systems is the need to regulate the influx of outside ambient air. One aspect of this regulation is the desired ability to prevent particulate matter from entering the ventilation system along with the outside ambient air, and louver assemblies have therefore been traditionally utilized to help control the flow of ambient air and any entrained particulate matter.

Recent natural disasters and code modifications have placed larger burdens on the performance of louver assemblies that are integrated into various ventilation systems. In particular, recent code modifications have centered on reducing or eliminating the amount of rain water (i.e., water droplets) that are permitted to pass through the louver assembly and into the ventilation system as a whole.

On this issue, louvers that attempt to separate water and other particles from air flowing into buildings are generally known in the art. As exemplified by U.S. Pat. No. 5,839,244, hereby incorporated by reference, such prior art louvers typically include a plurality of curved, spaced blades that define a plurality of spaced, serpentine-shaped air passageways therebetween. The air passageways direct air from the exterior of the building to the interior of the building for air conditioning of the building.

When air passes into the building through the air passageways, the water particles in the air, which are heavier than the gas molecules in the air, cannot turn through the serpentine-shaped contours in the air passageways. The water molecules therefore strike the walls of the blades, agglomerate into drops and flow by gravity down the blades and out of the louvers.

However, buildings in areas of the world that are especially prone to hurricanes face much tougher problems with the design of louvers. In such hurricane zones, wind-driven rain may sometimes pass through the louver and into the building. In other situations, rain may accumulate at the bottom of a louver and be pushed through the louver and into the building by a constant and steady airflow. In addition, hurricanes and tornadoes often pick up debris which may be propelled by strong winds into the louver. Depending on the size and speed of the debris, such debris may damage the louver and cause the localized yielding of welds, compromising the integrity and functionality of the louver. Moreover, increased wind speed and thus increased airflow often leads to blade flutter or "chatter," which is undesirable. In hurricane zones, such as Miami-Dade County in the state of Florida, stringent building codes have recently been adopted which require louvers, dampers and the like to pass stringent tests for wind and wind-driven rain resistance. Additional building code provisions often require such louvers to pass missile impact, static load and cyclic load tests at varying speeds, pressures and cycles.

Unfortunately, known louvers are simply not designed to withstand missile impacts of the size and speed often generated by strong storms such as hurricanes and tornadoes. Moreover, known louver assemblies have a substantial amount of blade "chatter" when subject to high winds or large airflow volumes.

Therefore, in order to achieve a sufficient wind and wind-driven rain resistance, known louvers often employ a separate damper assembly behind the louver to block off water penetration. However, the closing of the damper to block off water penetration also blocks the flow of air into the building, which disqualifies such louver/damper systems from use in hurricane zones or other areas that frequently see high winds and large amounts of rain.

Known louvers capable of expelling water are generally of two types. The first type is a louver that employs separate gutters or down spouts or other drainage systems for carrying the removed water away from the louver and out of the building. This type of louver is undesirable because a separate drainage system must be installed to carry the water out of the building. The second type of louver utilizes drain holes to expel water. In these louvers, there is an orifice or nozzle pressure present at these drain holes as well as in between each blade. However, until enough water builds up to overcome the orifice pressure and drain via the drain holes, the water built up inside the louver is carried though the louver and into the building with the airflow. An example of this type of louver is shown by U.S. Pat. No. 5,839,244 (Paul A. Johnson et al.).

SUMMARY OF THE INVENTION

In view of the foregoing, it is an object of the present invention to provide a louver assembly capable of resisting the influx of wind-driven water without the use of a corresponding damper.

It is another object of the present invention to provide a louver assembly having an improved blade design.

It is another object of the present invention to provide a louver assembly having an improved blade design for absorbing a missile's inertial force and for allowing blade deformation without any localized yielding of welds.

It is another object of the present invention to provide a louver assembly having an improved blade design to eliminate chatter under airflow.

It is another object of the present invention to provide a louver assembly with an improved blade and sill design to facilitate the draining of water removed from the air away from the louver and out or away from the building.

It is another object of invention to provide louver assembly that is designed to meet the stringent criteria established by the Florida Building Code and Miami-Dade County Building Code, including providing high volume flow rate, impact resistance, protection against water penetration and high wind-loads.

The louver assembly of the present invention includes a plurality of stacks, positioned adjacent one another front to back. Each stack includes a plurality of elongated blades, each having opposed lower and upper edges and a support frame for supporting the blades in a horizontally-spaced and vertically extending configuration so that the blades define therebetween a plurality of horizontally-spaced and vertically extending air passageways for the passage of air into a building. The stacks are aligned so that the passageways of the first stack are aligned with the passageways of the second stack in the general direction of airflow so as to create uniform elongated air passageways. The preferred support frame includes a bottom frame member or sill for receiving and/or supporting the lower edges of the blades and a head frame member for receiving and supporting the upper edges of the blades.

The preferred blades each include a screw boss at the leading edge of each blade. This screw boss acts as a "crush" point during missile impact, absorbing some of the missile's inertial force as well as allowing blade deformation without any localized yielding of welds. The preferred blades also include thicker leading and trailing edges, strengthening the blades over long spans and thus eliminating blade chatter under airflow.

The preferred louver assembly also includes a sloped sill and square cut blades. This design creates a void under the back blade stack which acts to equalize the orifice pressure within the louver, allowing the water to easily drain, regardless of the pressures exerted at the face of the louver.

BRIEF DESCRIPTION OF THE DRAWINGS

The present invention will be better understood from reading the following description of non-limiting embodiments, with reference to the attached drawings, wherein below.

DETAILED DESCRIPTION OF THE PREFERRED EMBODIMENTS

Figure 1:
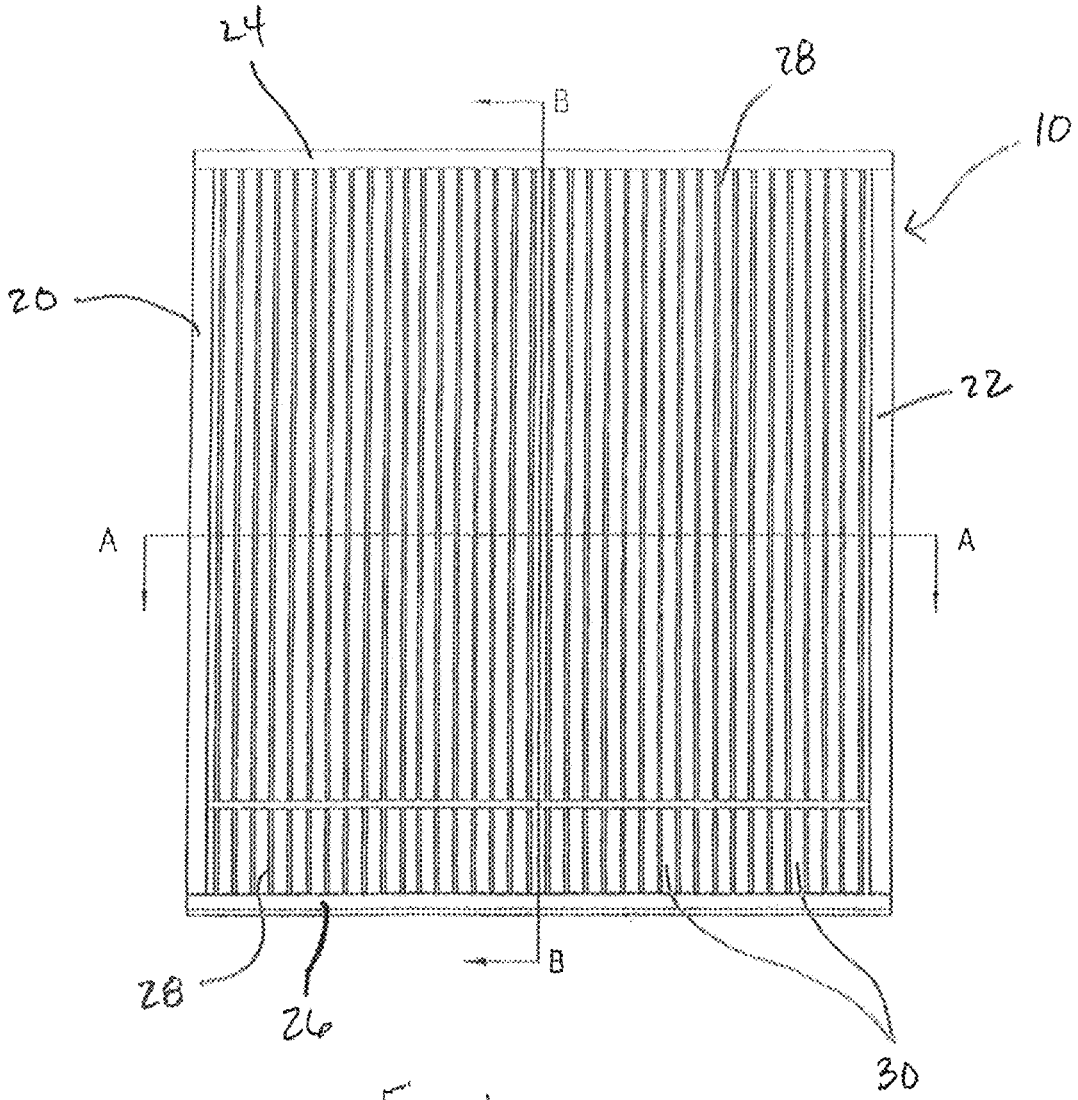
FIG. 1 is a simplified schematic front plan view of a louver assembly according to an embodiment of the present invention.
Figure 2:
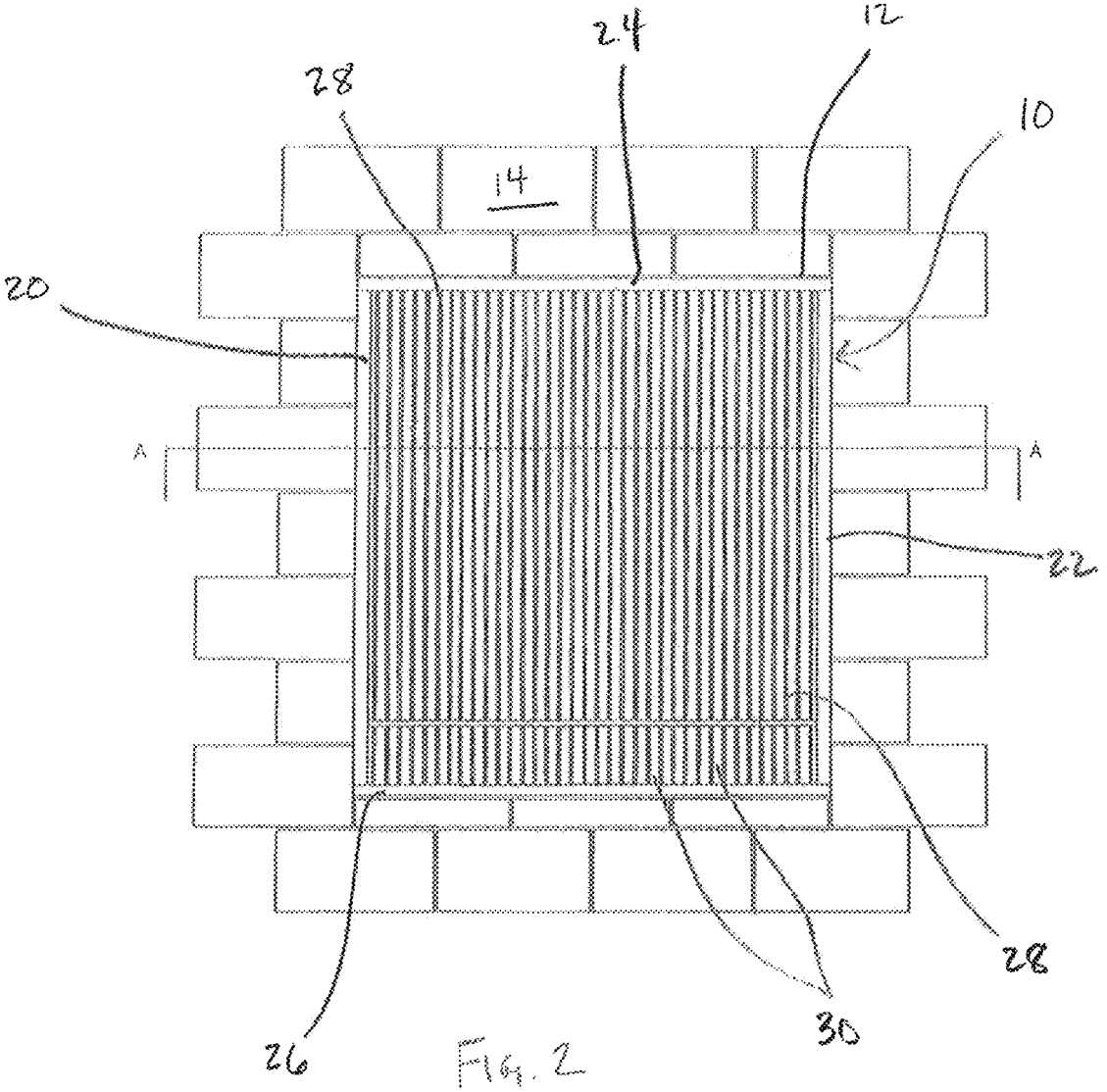
FIG. 2 is a simplified schematic front plan view of the louver assembly of FIG. 1 installed in an opening in a wall of a building according to an embodiment of the present invention.
Figure 3:
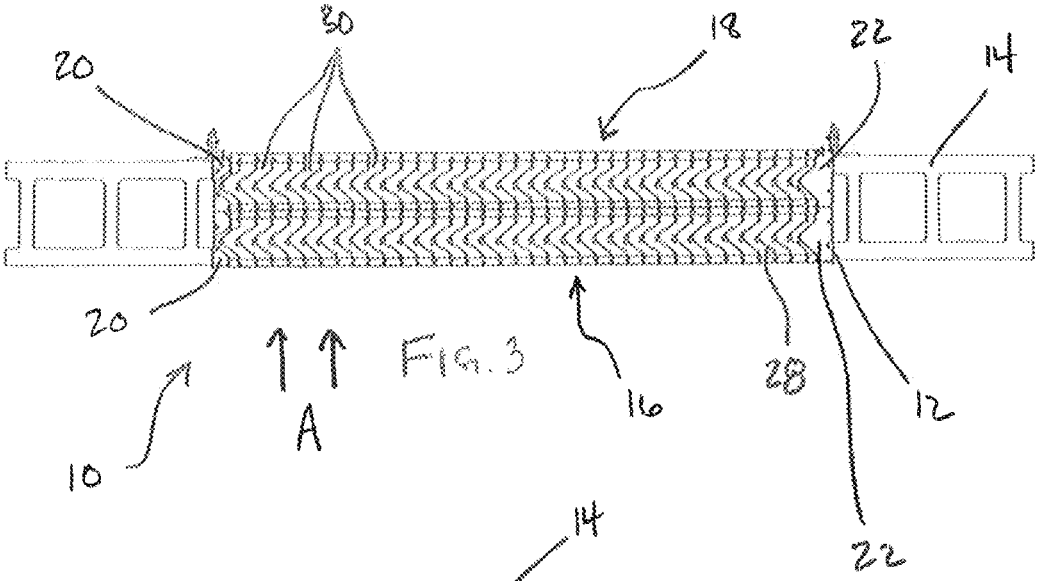
FIG. 3 is a sectional view of the louver assembly according to an embodiment of the present invention taken along line A-A of FIG. 2.
Figure 4:
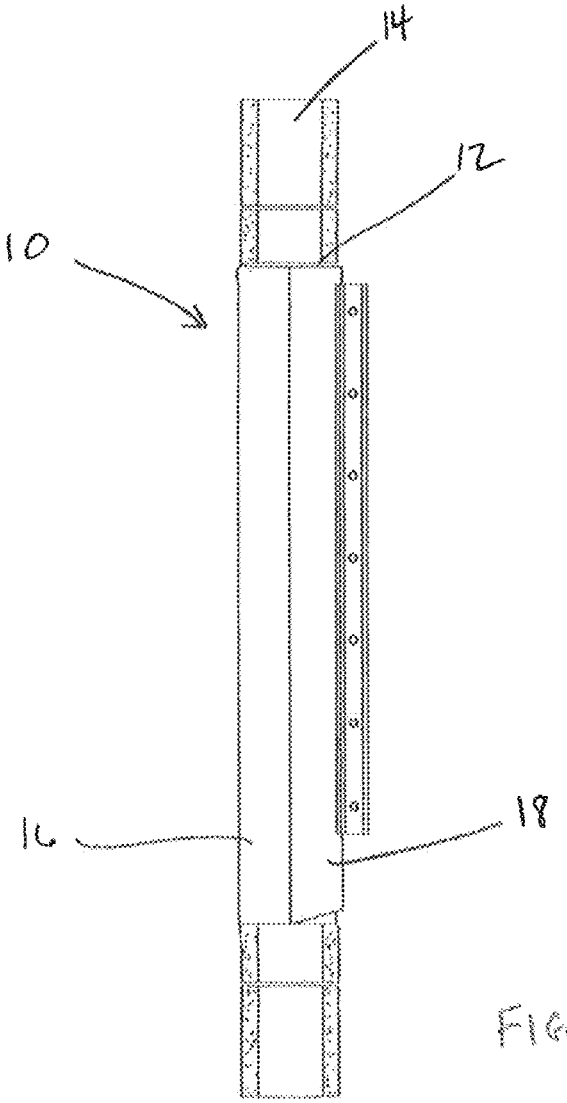
FIG. 4 is a simplified schematic side plan view of a louver assembly installed in an opening in a wall of a building according to an embodiment of the present invention.

One embodiment of a louver assembly of the present invention is indicated generally by reference numeral 10 in FIG. 1, and is designed to be inserted within an opening in a wall of a building to permit outside air to flow therethrough into the building while removing water particles from the air to prevent excess moisture from entering the building. FIGS. 2, 3 and 4 show such a louver assembly positioned within an opening 12 in a building 14.

While the louver assembly 10 is discussed as being disposed within an opening in a wall of a building or the like, it will be readily appreciated, however, that the louver assembly 10 may be integrated into any known ventilation system, including those systems having stand-alone components, without departing from the broader aspects of the present invention.

As best shown in FIGS. 3 and 4, the louver assembly comprises two vertical blade stacks, a first blade stack 16 and a second blade stack 18, arranged in tandem such that the first blade stack 16 faces outside the building in which it is installed and the second blade stack 18 is positioned directly behind the first blade stack.

With reference to FIGS. 1-3, each blade stack is bounded on the left side by a female jamb frame member 20 and on the right side by a male jamb frame member 22. The support frame for the louver assembly further includes a head frame member 24 which is wide enough to receive the upper edges of the blades in each blade stack, and a sill 26 which supports the bottom of each blade stack and facilitates the draining of water from the louver assembly, as described below. The head frame member 24 may extend the entire horizontal length of the opening, thus receiving the upper edge of each blade.

The male and female jamb members allow multiple louver assemblies to be joined together to span an opening of almost any dimension. In particular, when louvers are joined together or with additional louvers to span a wider opening, the end frame member on the right side of the left-most louver is replaced with a male-type jamb, and the end frame member on the left side of the right-most louver is replaced with a female-type end frame member.

As alluded to above, each blade stack 16, 18 of the louver assembly 10 includes a plurality of vertically extending blades 28 which, in the preferred embodiment, are uniformly spaced apart. The support frame, comprising the male and female jamb frame members 20, 22, the head frame member 24 and the sill 26, supports the blades 28 in a horizontally-spaced and vertically extending configuration such that the blades define therebetween a plurality of horizontally-spaced and vertically extending air passageways 30 for directing air from an exterior of the building to an interior of the building. The blade stacks 16, 18 are aligned so that the passageways of the first stack are aligned with the passageways of the second stack in the general direction of airflow so as to create uniform, elongated and serpentine shaped air passageways. (See FIG. 3).

Figure 5:
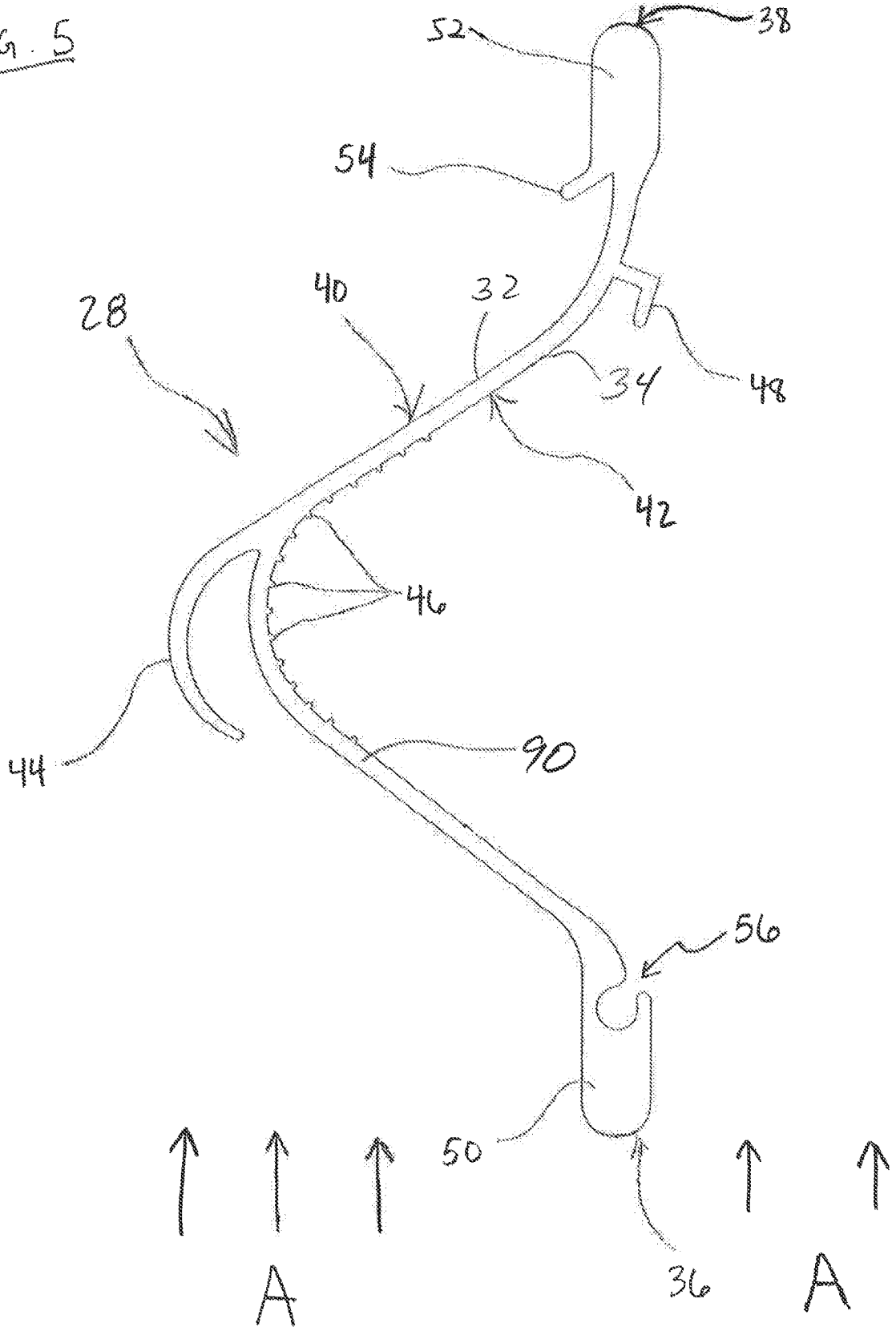
FIG. 5 is an enlarged top view of a blade of a louver assembly of FIGS. 1-4 according to an embodiment of the present invention.
Figure 6:
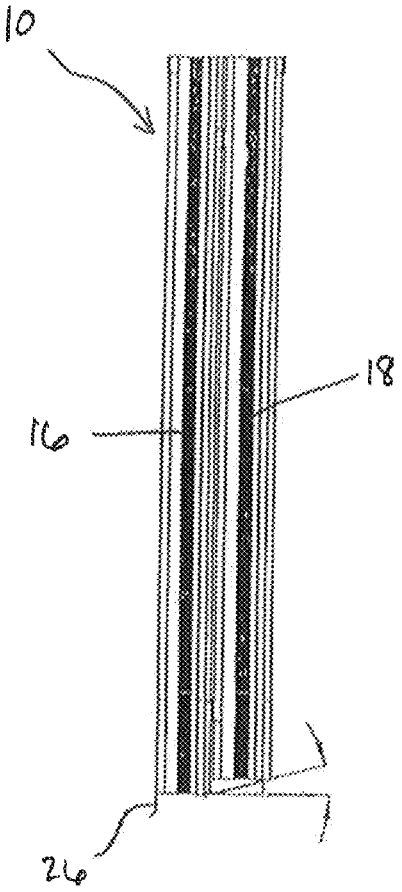
FIG. 6 is a sectional view of the louver assembly according to an embodiment of the present invention taken along line B-B of FIG. 1.
Figure 7:
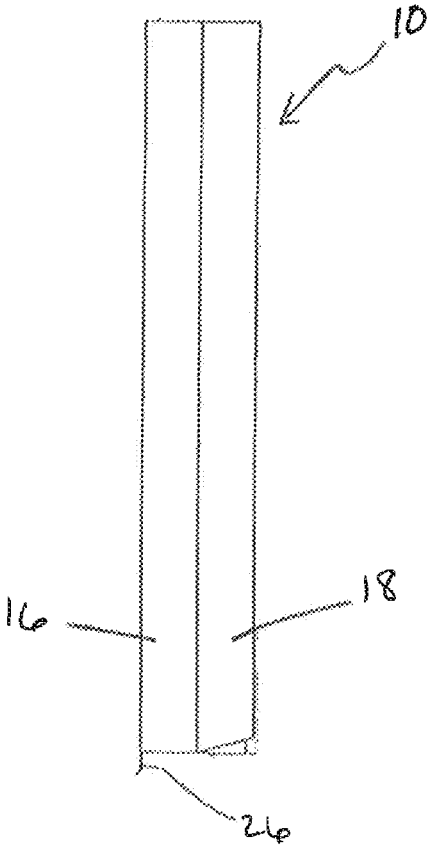
FIG. 7 is a simplified schematic side plan view of a louver assembly according to an embodiment of the present invention.

Referring now to FIG. 5, an exemplary blade 28 of the louver assembly 10 is shown. Each blade is preferably formed from extruded aluminum and presents a generally sine wave shaped profile having opposed lower and upper edges 32, 34, opposed leading and trailing edges 36, 38 and opposed right and left vertically extending faces 40, 42, respectively.

The blades 28 are positioned in the intermediate locations of the stacks 16, 18 between jamb members 20, 22. Each blade includes an arcuate hook 44 extending from its right face 40 in a direction generally towards the leading edge 36, and a plurality of horizontally-spaced projections 46 and an L-shaped tab 48 extending outwardly from its left face 42. Each blade 28 also includes a pair of enlarged tabs, a front tab 50 and a rear tab 52, at its leading and trailing edges 36, 38, respectively. The blades 28 also each include an angled tab 54 extending approximately from a point where the right face 40 meets the rear tab 54. These features cooperate to impede the flow of air-driven water particles through the louver assembly, as discussed below.

As further shown in FIG. 5, each blade 28 has a screw boss 56 formed in the front tab 50 adjacent the leading edge 36. The screw boss 56 is generally defined by a semi-circular cutout, void or channel in the front tab 50 which extends for the vertical height of the blade 28. The screw boss 56 acts as a "crush" point during missile impact, such as when debris may be throw at, or otherwise driven into, the louver assembly during high wind conditions. The screw boss 56 absorbs some of the missile's inertial force and allows for blade deformation without any localized yielding of welds. That is, the screw boss 56 allows for the leading and trailing edges 36, 38 to be manufactured thick enough to allow for the welding of the blades to the sill 26 while still allowing for blade deformation to absorb forces associated with missile impact. Moreover, as noted above, the blades 28 are configured with thicker front and rear tabs 50, 52, which act to strengthen the blade spans, thus eliminating blade "chatter" under airflow. In the preferred embodiment, the front and rear tabs 50, 52 are at least wider than the distance between the left face 40 and right face 42 (i.e., the width of the blade span) of the blades 26, and can even be twice or more times greater that the width of the blade span.

Figure 8:
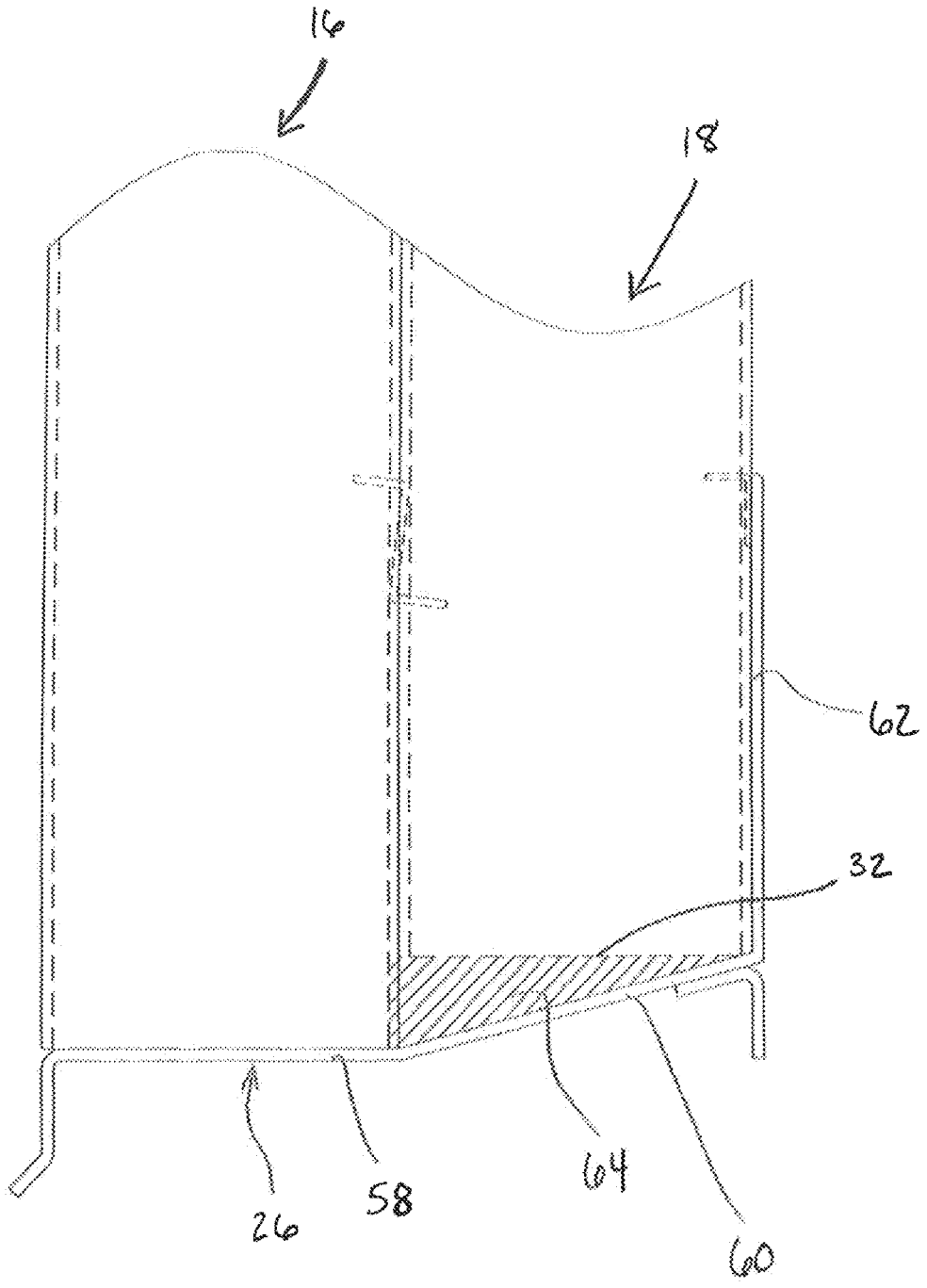
FIG. 8 is an enlarged partial side view of the louver assembly and sill according to an embodiment of the present invention.

Each blade stack, and the blades positioned therein, is supported by the sill 26. As best shown in FIG. 8, the sill comprises a generally planar first portion 58 for supporting the first blade stack 16, a sloped second portion 60 for accommodating and supporting the second blade stack 18, and a generally vertically extending backsplash portion 62 adjacent the sloped second portion 60 for further preventing water particles from passing through the louver assembly into the interior of the building. Preferably, the sloped portion 60 is at an angle of approximately 14 degrees from horizontal. Importantly, lower edges 32 of the blades 28 of the second blade stack 18 are square-cut, i.e. not mitered, such that the lower edges 32 of the blades 28 of the second stack 18 and the sloped portion 60 of the sill 26 define therebetween a void 64.

Returning now to FIGS. 3 and 5, in operation, air is directed into a building through the louver assembly 10 in the direction of arrows A. As the air traverses the passageways 30, the water particles in the air, which are heavier than the gas molecules in the air, cannot turn through the sine wave shaped contours. The water molecules therefore strike the walls of the blades 28 and are otherwise caught by the arcuate hook 44, projections 46, L-shaped tab 48 and angled tab 54 and removed from the air, thereby preventing the water molecules from passing through the assembly 10 and into the building. The water molecules that have been trapped by the blades 28 eventually agglomerate into drops and flow by gravity down the faces 40, 42 of the blades 28 to the sill 26 and out of the assembly, as hereinafter described.

Prior art louvers, such as that disclosed in U.S. Pat. No. 5,839,244, utilize drain holes to expel water that collects at the bottom of the louvers. With such louvers, there is an orifice or nozzle pressure at these drain holes as well as between each blade, so that until enough water builds up to overcome the orifice pressure and drain via the drain holes, water accumulates inside the louver and is carried through the louver with airflow and into the building.

With the present invention, however, the void 64 equalizes the pressure within the louver, allowing water to easily drain, regardless of pressures exerted at the face of the louver. Because the pressure within the louver assembly is equalized by the void 64, water particles that have been caught by the blades are permitted to flow onto the sill 26 and drain off the front of the sill 26 and out of the assembly 10. The sloped portion 60 of the sill 26 also aids in this draining by initiating a downhill stream of water, thereby pushing any water collected on the first planar portion 58 out of the assembly.

As will be readily appreciated, this blade/sill configuration does not allow rain, even wind-driven rain to penetrate the louver assembly and enter the building. Accordingly, no damper is needed to ensure that water does not pass through the louver, even in high wind or hurricane conditions. As such, the louver assembly of the present invention may be used to regulate the influx of outside ambient air even in storm conditions.

The components of each support frame described above are preferably formed from aluminum, but may also be formed of other suitable materials. When assembled, each blade stack 16, 18 is preferably 48" wide by 48" high, and 4" deep. As assembled, the entire louver assembly 10 and its support frame is approximately 48" wide by 48" high, and 8" deep, although multiple assemblies may be joined together as described above to span openings of greater dimension. In the preferred embodiment, the blades of each stack are uniformly spaced apart at a distance of approximately 1¼", measured from the center of one blade tab to the center of the next adjacent blade tab. In addition, each blade 28 takes up approximately 1.705" in width, measured from edge to edge, i.e., a point of tangential contact on the arcuate hook (left most edge) to a line drawn through the opposing edges of the tabs 50, 52 (right most edge).

In the preferred embodiment, the sill 26 is approximately 8.3" deep and 7.5" tall, and may include an angle (not shown) or other supporting structure beneath the backsplash portion 62 for supporting the rear-most portion of the sill 26.

Mounting of the louver assembly inside an opening in a building can be done by various techniques known in the art. As shown in FIGS. 3, 4 and 8, such mounting can be accomplished via the use of complimentary brackets and screws secured to the louver frame and to the building.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. A louver assembly for placement in an opening for regulating the inlet of air, comprising:

a plurality of elongated blades each having a leading edge and a trailing edge, at least one of said plurality of blades having a screw boss located adjacent said leading edge thereof for absorbing wind or debris forces acting on said assembly and for allowing for blade deformation under stress; and a support frame for supporting said blades in a horizontally-spaced and vertically extending configuration so that said blades define therebetween a plurality of horizontally-spaced and vertically extending air passageways for the passage of air.

2. The louver assembly according to claim 1, wherein:

said plurality of blades each include an arcuate hook extending from one of a left face and a right face thereof and extending towards said leading edge for capturing water particles from said air as it passes through said passageways.

3. The louver assembly according to claim 2, wherein:

said plurality of blades each include a plurality of horizontally-spaced projections extending outwardly from the other of said left face and said right face.

4. The louver assembly according to claim 2, wherein:

said plurality of blades each include an L-shaped tab extending outwardly from the other of said left face and said right face and located adjacent said trailing edge for capturing water particles from said air as it passes through said passageways.

5. The louver assembly according to claim 1, wherein:

said leading edge and said trailing edge of said plurality of blades are enlarged so as to strengthen said blades and to eliminate blade chatter under airflow.

6. A louver assembly for placement in an opening for regulating the inlet of air, comprising:

a first blade stack having a first plurality of blades arranged in a horizontally-spaced and vertically extending configuration;

a second blade stack having a second plurality of blades arranged in a horizontally-spaced and vertically extending configuration, said first blade stack and said second blade stack being arranged in tandem so as to define a plurality of horizontally-spaced and vertical extending air passageways for the passage of air there through; and a sill for supporting said first and second blade stacks, said sill having a planar first portion for supporting said first blade stack and a sloped second portion for supporting said second blade stack;

wherein said sloped portion and said second blade stack define therebetween a void for equalizing pressure within said assembly to facilitate the draining of water therefrom.

7. The louver assembly according to claim 6, wherein:

said sill further includes a vertically extending backsplash portion adjacent said sloped second portion for preventing water particles from passing through said assembly.

8. The louver assembly of claim 6, wherein:

said blades each include an arcuate hook extending from one of a left face and a right face thereof and extending towards a leading edge for capturing water particles from said air as it passes through said passageways.

9. The louver assembly according to claim 6, wherein:

said sloped second portion is sloped at an angle of 14 degrees from horizontal.

10. A blade for use in a louver assembly, comprising:

a first edge;

a second edge; and a pair of opposed first and second vertically-extending faces between said first edge and said second edge;

wherein said first edge and said second edge define enlarged tabs for strengthening said blade and eliminating blade chatter, said enlarged tabs having a width greater than a distance between said opposed first and second faces; and, wherein a screw boss is located adjacent said first edge configured to absorb wind or debris forces acting on said blade and for allowing for blade deformation under stress.

11. The blade for use in a louver assembly according to claim 10, further comprising:

an arcuate hook extending from one of said first and second opposed faces.

12. The blade for use in a louver assembly according to claim 11, further comprising:

a plurality of horizontally-spaced projections extending outwardly from the other of said first and second opposed faces.

13. The blade for use in a louver assembly according to claim 11, further comprising:

an L-shaped tab extending outwardly from the other of said first and second opposed faces and located adjacent said second edge.

14. The blade for use in a louver assembly according to claim 11, further comprising:

an angled tab extending towards said first edge from said same face as said arcuate hook and located adjacent said second edge.

15. The blade for use in a louver assembly according to claim 10, wherein:

said blade has a sine wave shaped profile.

* * * * *